US010098473B2

(12) United States Patent
Van Brussel et al.

(10) Patent No.: US 10,098,473 B2
(45) Date of Patent: Oct. 16, 2018

(54) SLEEPING SYSTEM

(71) Applicant: CUSTOM8 NV, Heverlee (BE)

(72) Inventors: Karel Jozef Van Brussel, Leuven (BE); Hans Lieve Jos Druyts, Boutersem (BE); Tom De Wilde, Rotselaar (BE)

(73) Assignee: CUSTOM8 NV, Leuven (BE)

( * ) Notice: Subject to any disclaimer, the term of this patent is extended or adjusted under 35 U.S.C. 154(b) by 109 days.

(21) Appl. No.: 15/125,657

(22) PCT Filed: Feb. 24, 2015

(86) PCT No.: PCT/EP2015/053771
§ 371 (c)(1),
(2) Date: Sep. 13, 2016

(87) PCT Pub. No.: WO2015/139921
PCT Pub. Date: Sep. 24, 2015

(65) Prior Publication Data

US 2017/0007032 A1 Jan. 12, 2017

(30) Foreign Application Priority Data

Mar. 17, 2014 (BE) ..... 2014/0182

(51) Int. Cl.
*A47C 19/02* (2006.01)
*A47C 23/06* (2006.01)

(52) U.S. Cl.
CPC ..... *A47C 19/025* (2013.01); *A47C 23/067* (2013.01); *A47C 23/068* (2013.01)

(58) Field of Classification Search
CPC ..... A47C 19/025; A47C 23/067; A47C 23/06
See application file for complete search history.

(56) References Cited

U.S. PATENT DOCUMENTS

| | | | | |
|---|---|---|---|---|
| 4,222,134 A * | 9/1980 | Degen | A47C 23/064 5/191 |
| 4,752,981 A * | 6/1988 | Salens | A47C 23/067 5/238 |
| 5,282,285 A * | 2/1994 | de Gelis | A47C 23/063 5/237 |
| 6,219,863 B1 * | 4/2001 | Loberg | A47C 19/005 5/200.1 |

(Continued)

FOREIGN PATENT DOCUMENTS

| | | |
|---|---|---|
| DE | 94 09 812 U1 | 10/1995 |
| DE | 197 26 793 C1 | 10/1998 |
| DE | 20 2007 002219 U1 | 5/2007 |

(Continued)

OTHER PUBLICATIONS

PCT International Search Report and Written Opinion dated Apr. 28, 2015 for PCT International Patent Application No. PCT/EP2015/053771, 9 pages.

(Continued)

*Primary Examiner* — Eric J Kurilla
(74) *Attorney, Agent, or Firm* — Amster, Rothstein & Ebenstein LLP

(57) ABSTRACT

The present invention relates to an adaptive sleeping system which makes it possible to adapt the resilient capacity at various positions to the anatomy and/or position of the user.

15 Claims, 12 Drawing Sheets

(56) References Cited

U.S. PATENT DOCUMENTS 6,877,174 B2 * 4/2005 Lobry ..... A47C 23/064
5/236.1
6,983,497 B2 * 1/2006 Lobry ..... A47C 23/0431
5/236.1

FOREIGN PATENT DOCUMENTS

FR 2 890 839 A1 3/2007
JP S62-52462 U 4/1987

OTHER PUBLICATIONS

PCT Notification Concerning Transmittal of International Preliminary Report on Patentability and Written Opinion of the International Searching Authority, dated Mar. 2, 2016 in connection with PCT International Patent Application No. PCT/EP2015/053771, 6 pages.
Reply filed on Jan. 14, 2016 in response to the International Preliminary Report on Patentability and Written Opinion in connection with PCT International Patent Application No. PCT/EP2015/053771, 4 pages.

* cited by examiner

SLEEPING SYSTEM

CROSS-REFERENCE TO RELATED APPLICATIONS

This application is a U.S. national stage entry under 35 U.S.C. § 371 of PCT International Patent Application No. PCT/EP2015/053771, filed Feb. 24, 2015, which claims priority to Belgian Patent Application No. 2014/0182, filed Mar. 17, 2014, the contents of which are incorporated herein by reference in their entirety.

TECHNICAL FIELD

The present application relates to an adaptive sleeping system which makes it possible to actively and/or passively adjust the resilient capacity to the anatomy and/or position of the user.

BACKGROUND

Although a good sleeping comfort forms a significant contribution to the wellbeing of an individual, few sleeping systems offer optimum body support to the user. In a large number of sleeping systems, the user rests on a mattress which is supported by a slatted base. In order to offer the various body zones suitable support, various systems allow local adjustment of the resilient capacity of the slatted base. Thus, for example, the zone at the location of the hips can be made less resilient than the zone at the location of the torso. A number of such systems use pairs of slats which can be tensioned via a pair of sliding devices, as described in European patent application EP 0 919 163. Such sleeping systems have the drawback that they are set beforehand and any changes in the recumbent position of the user, for example from a lateral position to a dorsal position are not taken into consideration.

Other sleeping systems divide the pressure on the body of the user in a passive way, on account of the weight of the user. An example of such a system is a water bed. Although such sleeping systems adjust to the position of the user, they generally have the disadvantageous effect that the zone at the position of the hip will sink too low, thus compromising good body support.

Adaptive sleeping systems may provide a solution to these problems. Such systems can actively change the body support of an individual while they are sleeping in such a way that it satisfies the highest requirements regarding body support. Currently, there are only a limited number of such systems on offer. European patent EP 2 255 293 describes a sleeping system, in which, based on various measurements, a number of different zones in the system are controlled which are thus able to support the body in an optimum way. This is achieved via separately inflatable chambers. The control of the zones can be effected completely autonomously while the user is sleeping. Other systems are based on a plurality of pretensioned spring units.

However, due to their high complexity and cost, such adaptive systems are mainly used for analysing the sleeping behaviour of individuals and not as a sleeping system for daily use.

SUMMARY

The modules for use in a sleeping system described herein make it possible to adjust the rigidity of a surface in a simple way. In addition, the sleeping systems provided herein and consisting of different modules which form different zones have the advantage that different zones can be set in order to offer different levels of support. In addition, the systems described herein may be set as adaptive sleeping system.

More particularly, the present invention provides a module (100) for a sleeping system, comprising

- a first horizontal slat (110) and a second horizontal slat (120), the first horizontal slat (110) being positioned above the second horizontal slat (120), wherein the ends of the first horizontal slat (110) and the second horizontal slat (120) are connected to each other in pairs by means of coupling elements (112,114,) without the first horizontal slat (110) and the second horizontal slat (120) directly touching one another; and
- a sliding system (140), comprising two or more sliding elements (141-146) which differ from the coupling elements (112, 114), wherein
  - the two or more sliding elements (141-146) are configured to slide over at least part of the length of the second horizontal slat (120); and
  - the position of the two or more sliding elements (141-146) determines the resistance to bending or torsion of the second horizontal slat (120).

In preferred embodiments, the first horizontal slat does not directly contact the sliding elements (141-146).

In specific embodiments, the module furthermore comprises a third horizontal slat (130) positioned between the first horizontal slat (110) and the second horizontal slat (120), wherein the third horizontal slat (130) is coupled to the second horizontal slat (120) by means of the two or more sliding elements (141,142), which can each be displaced over at least part of the length of the second horizontal slat (120) and of the third horizontal slat (130). In further embodiments, the third horizontal slat (130) is longer than the second horizontal slat (120).

In certain embodiments of the module, the two or more sliding elements (143,144) support the second horizontal slat (120), preferably by means of roller elements, and can each be displaced over at least part of the length of the second horizontal slat (120).

In specific embodiments of the module the two or more sliding elements (145, 146) ensure a fixed position of the portion of the second horizontal slat (120) between the sliding elements (145, 146) with respect to the floor; and the coupling elements (112, 114) are configured to cause a rotational change in position of the ends of the second horizontal slat (120) when the height of the first horizontal slat (110) with respect to the floor changes.

In particular embodiments, the second horizontal slat comprises two or more interconnected parts or slats which are positioned in line with each other.

In specific embodiments of the module, the second horizontal slat (120) is coupled to a central support element (150) for supporting the module (100) on the floor, wherein the two or more sliding elements (141-146) are situated at opposite sides of the support element (150).

In specific embodiments of the module, one or both ends of the second horizontal slat (120) are furthermore provided with a resilient element and/or an attenuating element.

In specific embodiments of the module, the two or more sliding elements (141-146) are driven by an actuator (147-149). In further embodiments, the actuator comprises a rack and pinion system (149).

In specific embodiments, the module furthermore comprises one or more sensors which control a drive mechanism of the two or more sliding elements (141-146).

In specific embodiments of the module, the first horizontal slat (110) has a greater stiffness than the second horizontal slat (120).

The present invention furthermore provides a modular sleeping system which comprises two or more modules (100) as described herein.

In specific embodiments of the sleeping system, the two or more modules (100) are coupled to each other in such a way that the first horizontal slats (110) and the second horizontal slats (120) of the different modules (100) are positioned parallel to one another, wherein the first horizontal slats (110) of the modules (100) together form a lying surface.

In particular embodiments of the modular sleeping system is a system wherein

- the modules (100) each comprise a third horizontal slat (130) as described herein;
- the modular sleeping system further comprises a frame (160) at least partially surrounding the modules (100); and
- each of the modules (100) is suspended from said frame (160) via said third horizontal slat (130).

In specific embodiments of the sleeping system, the two or more modules (100) are supported by a central support element (150).

In specific embodiments, the sleeping system furthermore comprises one or more sensors which control the drive mechanism of the two or more sliding elements (141-146), wherein the one or more sensors are provided in a mat which is provided above the first horizontal slats (110) of the two or more modules (100).

In specific embodiments, the sleeping system comprises at least two groups of in each case one or more modules, wherein each group is provided with a separate actuator for driving the two or more sliding elements (141-146) within the respective group.

The present invention furthermore provides the use of a module as described herein as part of a sleeping system.

In specific embodiments, the sleeping systems described herein have the advantage that the resilient capacity of the sleeping system or of a part thereof can easily be adjusted, even while the user is sleeping. Thus, the sleeping system is able to offer optimum body support and may have a direct positive effect on the wellbeing of the user. The simple construction makes it possible to produce the sleeping system in a cost-efficient way. The construction from different modules furthermore makes it possible to allow for the demographic difference in length and/or the specific wishes of the user.

DESCRIPTION OF THE FIGURES

The following description of the figures of specific embodiments of the systems described herein is only given by way of example and is not intended to limit the present explanation, its application or use. In the drawings, corresponding reference numbers refer to the same or similar parts and features.

DESCRIPTION OF THE INVENTION

Figure 1A:
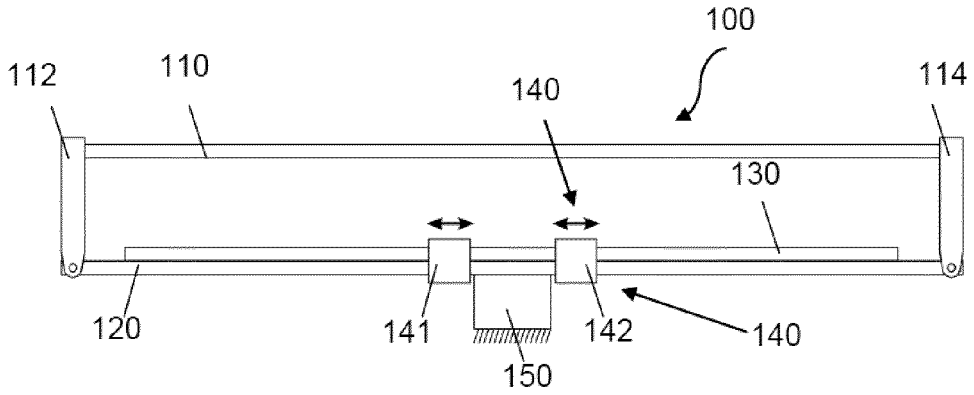
FIG. 1 Module (100) according to a specific embodiment of the present invention, wherein, in FIGS. 1A and 1B, the position of the sliding elements (141,142) permits a relatively large degree of bending of the second horizontal slat (120), and wherein, in FIGS. 1C and 1D, the position of the sliding elements (141,142) only permits a relatively small degree of bending of the second horizontal slat (120).
Figure 1B:
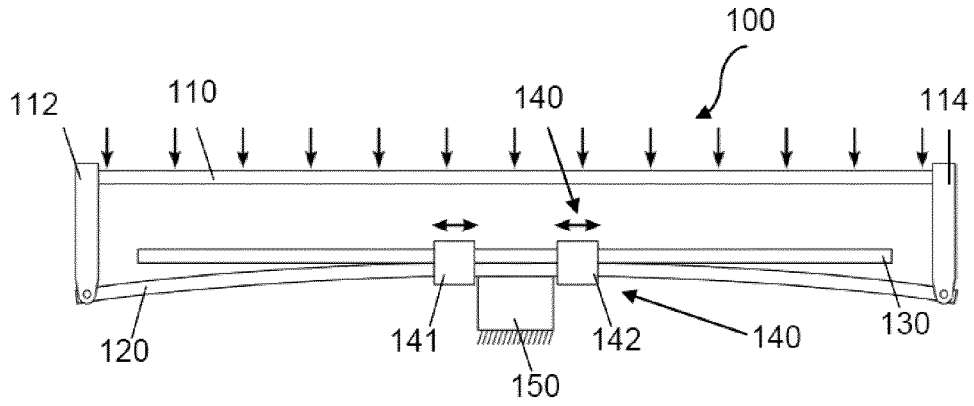
Figure 1C:
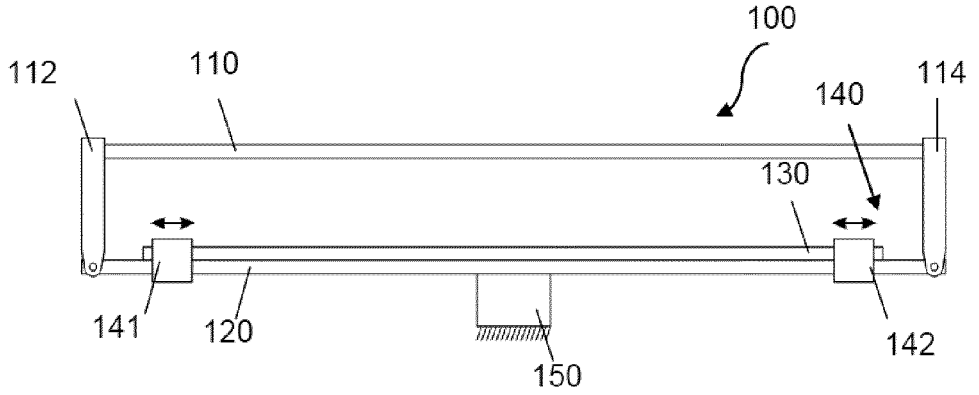
Figure 1D:
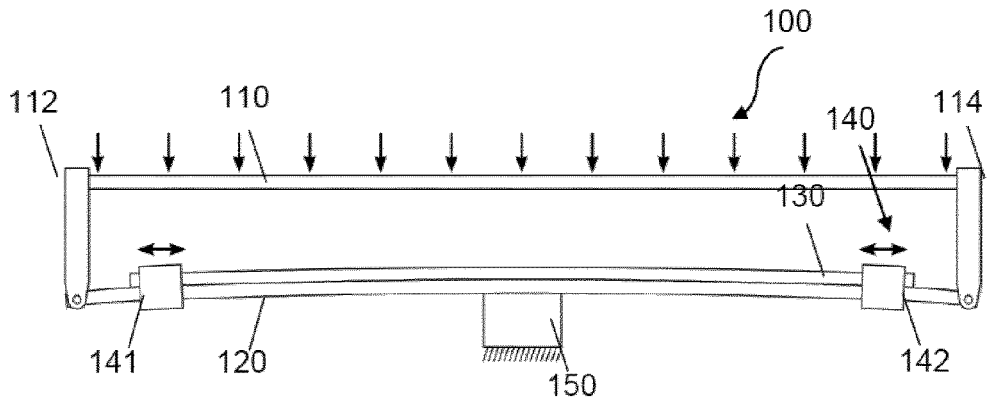

As used below in this text, the singular forms "a", "an", "the" include both the singular and the plural, unless the context clearly indicates otherwise.

The terms "comprise", "comprises" as used below are synonymous with "including", "include" or "contain", "contains" and are inclusive or open and do not exclude additional unmentioned parts, elements or method steps. Where this description refers to a product or process which "comprises" specific features, parts or steps, this refers to the possibility that other features, parts or steps may also be present, but may also refer to embodiments which only contain the listed features, parts or steps.

The enumeration of numeric values by means of ranges of figures comprises all values and fractions in these ranges, as well as the cited end points.

The term "approximately" as used when referring to a measurable value, such as a parameter, an amount, a time period, and the like, is intended to include variations of +/−10% or less, preferably +/−5% or less, more preferably +/−1% or less, and still more preferably +/−0.1% or less, of and from the specified value, in so far as the variations apply to the invention disclosed herein. It should be understood that the value to which the term "approximately" refers per se has also been disclosed.

All references cited in this description are hereby deemed to be incorporated in their entirety by way of reference.

Unless defined otherwise, all terms disclosed in the invention, including technical and scientific terms, have the meaning which a person skilled in the art usually gives them.

For further guidance, definitions are included to further explain terms which are used in the description of the invention.

As referred to herein, an object is "elongate" if the length of said object is greater than four times the width of said object; preferably the length is greater than six or eight times the width of the object.

As referred to herein, an object is "thin" if the width of said object is greater than two times the thickness of said object; preferably the width is greater than four or six times the width of the object.

The term "end" of a slat, as used herein, also comprises parts of the slat which are situated near that end; more particularly parts which are at a distance from the end which is smaller than 10% of the length of the slat, preferably smaller than 5% of the length of the slat.

The term "perpendicular", as used herein, may comprise a certain deviation from an exactly perpendicular orientation. More particularly, a first (surface) object is deemed to have been positioned perpendicularly with respect to a second (surface) object if the angle between the surfaces determined by these objects is between 85° and 95°, preferably between 87° and 92°, more preferably between 88° and 91°, and most preferably 90°.

The term "parallel", as used herein, may comprise a certain deviation from an exactly parallel orientation. More particularly, a first (surface) object is deemed to be positioned parallel with respect to a second (surface) object if the angle between the surfaces determined by these objects is between 0° and 5°, preferably between 0° and 2°, more preferably between 0° and 1°, and most preferably 0°.

The term "lying surface", as used herein, denotes the surface of the sleeping system for supporting a mattress or the like.

The term "sleeping system", as used herein, refers to an arrangement, such as a bed, which is generally used for sleeping. However, it will be clear to those skilled in the art that this term is not intended to express a limitation with regard to the possible use of the systems. Thus, the sleeping systems described herein can also be used to lie on, without this necessarily involving sleeping.

The present application relates to a modular sleeping system which permits adjustment of the resilient capacity to the anatomy and/or position of the user. The sleeping system may be constructed from a number of base modules, in which case each module comprises a set of slats situated one above the other. Below, these features will be explained further.

In this case, in a first aspect, a module (100) is provided for a sleeping system, comprising a set of slats (110,120, 130) situated one above the other, more particularly horizontal slats (110,120,130). This means that the slats are positioned parallel with respect to each other and that they are typically positioned horizontally during use of the module. If the slats have wide surfaces, the wide surfaces of the horizontal slats preferably face each other.

Below, the outer two slats of the set are referred to as the "first horizontal slat" (110) and the "second horizontal slat" (120), respectively, or also "first slat" and "second slat". A third horizontal slat (130), which is usually situated between the first slat (110) and the second slat (120), is also referred to herein as the "third horizontal slat" (130), or also "third slat".

More particularly, provided herein is a module (100) for a sleeping system, comprising

- a first horizontal slat (110) and a second horizontal slat (120), the first horizontal slat (110) being positioned above the second horizontal slat (120), wherein the ends of the first horizontal slat (110) and the second horizontal slat (120) are connected to each other in pairs by means of coupling elements (112,114) without the first horizontal slat (110) and the second horizontal slat (120) directly touching one another; and
- a sliding system (140), comprising two or more sliding elements (141-146) which differ from the coupling elements (112, 114), wherein
  - the two or more sliding elements (141-146) are configured to slide over at least part of the length of the second horizontal slat (120);
  - the position of the two or more sliding elements (141-146) determines the resistance to bending or torsion of the second horizontal slat (120); and
  - the first horizontal slat does not directly contact said sliding elements (141-146).

More specifically, the first horizontal slat does not directly contact the sliding elements under normal load. Accordingly, the first horizontal slat does not need to contact the sliding elements in order to adapt the rigidity of the module. This allows to regulate the rigidity of the module in a simple way, even under load.

In specific embodiments, the modules described herein may also comprise other slats. Thus, it is possible to provide, for example, one or more additional slats above, below or next to the first slat.

The term "slat", as used herein, refers to an elongate body, and may comprise a rod having a rectangular, square, circular, oval or other cross section. The slats are preferably straight, but may be slightly curved. The slats may be solid, but may also comprise openings, such as for example hollow slats. Thus, for example, one or more slats may comprise a grate structure.

In a preferred embodiment, at least the first horizontal slat is a straight, elongate and thin body. Thus, the first horizontal slat forms a wide surface which may serve to form the lying surface of a sleeping system (see below). In specific embodiments, at least the first horizontal slat is a straight, elongate and thin body having a thickness of between 0.3 cm and 5 cm, a width of between 5 cm and 50 cm, and a length of between 60 cm and 200 cm.

In specific embodiments, the first horizontal slat and the second horizontal slat form a straight, elongate and thin body, as described above. In specific embodiments, the first horizontal slat, the second horizontal slat and the third horizontal slat form a straight, elongate and thin body, as described above. However, this is not critical to the operation of the module described herein. In specific embodiments, the first horizontal slat is a straight, elongate and thin body as described above; and the second horizontal slat and the third horizontal slat (if present) are (straight) rods. In particular embodiments, the second horizontal slat may be pre-stressed, thereby deviating from a straight shape.

In specific embodiments, (a straight,)elongate and thin body as described above may be bar-shaped, but this is not compulsory. It is, for example, possible for the shape of the lateral surfaces to deviate from a quadrangle, and/or for the angle between adjacent lateral surfaces of the slat to deviate from 90°. It is also possible for the corners of adjacent lateral surfaces to be rounded and/or for one or more lateral surfaces to have a non-flat, for example (slightly) undulating shape.

In particular embodiments, the first, second, and third slat described herein each are provided as a single part. However, it is envisaged that one or more of the slats may be formed from two or more parts which are connected to each other. This may facilitate transport and assembly of the modules described herein. The connection may be a direct connection or indirect connection via an intermediate connector.

In certain embodiments, the second slat (120) is formed of two or more interconnected parts. The second slat (120) may comprise two interconnected parts or slats which are positioned in line with each other. More particularly each of the parts has a first and second end wherein the first ends face each other whereas the second ends are considered forming the ends of the second slat (120). The two parts may be connected directly to each other, or indirectly, e.g. via the third slat (130) if present.

In the module described herein, the first slat (110) and the second slat (120) are connected to each other at both ends, for example by means of coupling elements (112,114). More particularly, the ends of the first slat (110) and the second slat (120) are connected to each other in pairs. In other words, a first end of the first slat (110) is connected to a first end of the second slat (120), for example by a coupling element (112), and the second end of the first slat (110) is connected to the second end of the second slat (120), for example by a coupling element (114). Typically, the first slat (110) and the second slat (120) are placed parallel with respect to each other, although a deviation therefrom is not excluded. For example, the first slat (100) may be straight while the second slat (120) may be slightly bent.

The first slat (110) and the second slat (120) are connected to each other at their ends, but without (the longitudinal sides of) the first (110) and the second slat (120) directly touching each other. In other words, the first (110) and second slat (120) are connected to each other with a certain distance in between, so that a free space is created between these slats (110,120). This permits a certain degree of bending of the slats (110,120) with respect to each other and/or torsion of the second slat and furthermore permits a third slat (130) to be positioned between the first (110) and the second (120) slat (see below).

The connections between the ends of the first slat (110) and the second slat (120) may be rigid or permit a certain degree of bending, but ensure that the (ends of the) slats (110, 120) maintain a certain distance with respect to each other. In embodiments where the position of the sliding elements determines the resistance to bending of the second horizontal slat, the connections between the ends of the first slat and the second slat preferably ensure a fixed position of the ends of the slats (110,120) with respect to each other.

In specific embodiments, the connection may be secured by a coupling element (112,114). This coupling element (112,114) may be made from the same material or another material than the first (110) and/or second slat (120). In specific embodiments, the connection forms a single entity with the first (110) and/or second slat (120). In more specific embodiments, the first (110) and second slat (120) and the connections between them form a frame.

In specific embodiments, the coupling element may be hingedly connected to the first horizontal slat and/or the second horizontal slat. More specifically, in certain embodiments, the coupling element may be hingedly connected to the second horizontal slat and be rigidly connected the first horizontal slat. Providing such a hinged connection may facilitate bending of the second slat when the first horizontal slat is under load, without compromising the structural integrity of the module.

In a preferred embodiment, the module (100) furthermore comprises a third horizontal slat (130) which is situated between the first slat (110) and the second slat (120). The third slat (130) is coupled to the second slat via a pair of separate sliding elements (141,142) which differ from the coupling elements (112, 114) and which can each be displaced over at least part of the length of the second (120) and third slat (130). Together, the second slat (120), the third slat (130), and the sliding elements (141, 142) form a leaf spring with a variable stiffness.

As described above, the sliding elements can be provided such that they do not directly contact the first horizontal slat (110), even under load. In this way, the sliding elements can be moved at any time, even when the user is sleeping.

Any element which couples the two slats (120,130) to each other and can be displaced over the length of the slats (120,130) can be used as sliding element (141,142).

A sliding element (141,142) may, for example, have a ring structure and/or form a clamp. If the sliding element (141, 142) receives the slats via an opening, it may comprise one single opening or slot for receiving both the second slat (120) and the third slat (130); or a separate opening or slot for the second slat (120) and a separate opening or slot for the third slat (130) etc.

The sliding elements (141,142) may be made from any material which offers sufficient strength to keep the slats (120,130) together. Such materials are well-known by those skilled in the art and comprise, for example, metals, plastics, wood, and the like. In specific embodiments, the sliding element (141,142) is made of metal, for example (stainless) steel.

As mentioned above, the two sliding elements (141,142) can be displaced with respect to each other over at least part of the length of the second (120) and third slat (130). In a preferred embodiment, each sliding element (141,142) can be displaced over at least 10% of the total length of the second slat (120). In particular embodiments, each sliding element can be displaced over at 15%, of the length of the second slat (120).

In particular embodiments, each sliding element (141, 142) can be displaced over at least 20% the length of the second slat (120), for example about 30%, of the length of the second slat (120). In this case, the person skilled in the art will understand that a displacement of the two sliding elements (141,142) with respect to each other over a specific length of the second slat (120) will result in a similar displacement of the sliding elements (141,142) with respect to each other on the third slat (130) due to the fact that the sliding elements couple the second (120) and third slat (130) to each other. However, the exact distance between both sliding elements (141,142) is not necessarily identical on the third slat (130) and on the second slat (120). As will be described further below, the second (120) and the third slat (130) may also differ in length, as a result of which the relative displacement of the sliding elements (141,142) with respect to the total length of the slat (120,130) may also differ.

In this case, an embodiment is more particularly configured such that the sliding elements (141,142) are displaced in opposite directions to each other over at least part of the length of the second slat (120) (and therefore also of the third slat (130)). The distance between the sliding elements (141,142) determines the degree to which the second slat (120) can be bent independently from the third slat (130). The further apart the sliding elements (141,142) are, the more the bendability (and the resilient capacity) of the second slat (120)—and thus of the entire module (100)—is partly determined by the third slat (130). Pushing the sliding elements (141,142) apart thus results in a module (100) which bends less under load compared to a module (100) in which the sliding elements (141,142) are placed closer together. This is explained in more detail in the examples.

In specific embodiments, the second slat (120) and, if present, the third slat (130) may be provided with a rail system over which the sliding elements (141,142) can be displaced.

In specific embodiments of the module described herein (100), the second slat (120) and the third slat (130), which are connected to each other via the sliding elements (141, 142), are a specific distance apart. This may be achieved, for example, by providing a central (with respect to the longitudinal axis) spacer between the second slat (120) and the third slat (130). In specific embodiments, the distance between the second (120) and the third slat (130) is ensured by the sliding elements (141,142). In specific embodiments, the second slat (120) and the third slat (130) are a distance of between 5 mm and 5 cm apart, preferably between 5 mm and 3 cm. Such a configuration may permit fitting of a drive shaft of an actuator (147) between the second slat (129) and the third slat (130). Such an actuator (147) can be used to check the position of sliding elements (141,142) (see below). However, it is not impossible for the second slat (120) and the third slat (130) to be in direct contact with each other in other embodiments. In certain embodiments, the outer ends of the second and third slat may touch each other, while a gap is provided between the slats in the center.

In a particular embodiment, the module does not comprise a third slat (130), but does comprise sliding elements (143, 144) which differ from the coupling elements (112, 114) which support the second slat (120). Preferably, such sliding elements (143, 144) are configured as roller elements. It is thus possible to take advantage of the bending stiffness of the second slat (120) in different ways: via a third slat (130) which bends along and sliding elements (141,142) which couple the second slat (120) and the third slat (130) to each other and thus increase or reduce the bending stiffness, or via sliding supports or roller elements (143,144) which support the second slat (120) to a greater or lesser degree.

In a specific embodiment, the position of the sliding elements does not determine the bending strength of the second slat (120), but the torsion strength of the second slat.

In such an embodiment, the connections between the ends of the first slat (110) and the second slat (120) ensure that the ends of the second slat can rotate about the longitudinal axis of the second horizontal slat when the first horizontal slat is subjected to a load. More particularly, the connection between the first horizontal slat and the second horizontal slat may be secured by a coupling element (112, 114) which permits a rotation of the second horizontal slat (120) about its longitudinal axis (or an axis parallel to the longitudinal axis) when a load is applied to the first horizontal slat (110). Such a coupling element (112, 114) may consist of several separate parts which can move with respect to each other.

In an embodiment based on torsion of the second slat (120), the sliding elements (145, 146) (which differ from the coupling elements) are also configured to slide over at least part of the length of the second horizontal slat, as described above. Furthermore, in this embodiment, the sliding elements (145, 146) usually have a fixed distance with respect to the floor and a fixed rotational position, and the sliding elements (145, 146) block the position of the part of the second slat (120) which is situated between the sliding elements (145, 146). The presence of a third slat (130) is not required in such an embodiment.

The combination of the sliding elements (145, 146) and the connection between the first slat and the second slat ensures that the free ends of the second slat (this is the part of the second slat which is not situated between the sliding elements) are able to perform a torsional movement when the first slat is subjected to a load.

The distance between the sliding elements (145, 146) determines the torsional stiffness of the free ends of the second slat (120): the greater the distance between the sliding elements, the greater the torsional stiffness and the smaller the change in position of the first slat under a specific load.

In the module described herein (100), and thus also in the sleeping system which is described herein and comprises the modules (100), the position of the first slat (110) is therefore partly determined by the bending or torsion of the second slat (120), which will fundamentally depend on the load to which the module (100) is subjected and on the position of the sliding elements (141-146), without requiring contact between the first slat and the sliding elements. In order to permit the position (height) of the first slat (110) in the module (100) to be varied, a certain distance is provided between the first slat (110) and the second slat (120). However, the absolute value of this distance is not critical, as long as it ensures that the first slat (110), even when it is subjected to load during use, does not touch the second slat (120) (and/or the third slat (130), if present) and the sliding elements (141-146). In specific embodiments, the distance between (the flat side of) the first slat (110) and (the opposite flat side of) the second slat (120) is between 1 cm and 25 cm, preferably between 2 cm and 15 cm, more preferably between 3 and 10 cm (in the unloaded state of the module (100)).

The first (110) and second slat (120) of the module described herein (100) typically have a similar length, although this is not compulsory. It is thus possible for the first slat (110) to be longer than the second slat (120) and vice versa. In a preferred embodiment, the longer of these two slats (110,120) is at most 25% longer than the shorter of these two slats (110,120). In specific embodiments, the first slat (110) and the second slat (120) are of equal length.

In specific embodiments, the first slat (110) is stiffer than the second slat (120). In this way, the stiffness of the module is mainly determined by the second slat (120) (optionally in cooperation with the third slat (130)). This can be achieved by using a first slat (110) which is thicker than the second slat (120) and/or by making the first slat (110) from a material having a greater stiffness than the material used to produce the second slat (120).

If present, the third slat (130) (positioned between the first slat (110) and the second slat (120)) may be shorter or longer than the first slat (110) and the second slat (120). If the third slat (130) is longer than the first and/or second slat, the connection between the first slat (110) and the second slat (120) may, for example, provide an opening which serves as a passage for the third slat (130).

A longer third slat may be preferred if the module is to be suspended from a bed frame via the ends of the third slat (see further). Accordingly, in particular embodiments, the length of the third slat (130) is at least 105% of the length of the second slat (120).

However, this is not critical to the present invention.

In other embodiments, the length of the third slat (130) is 75 to 100% of the length of the second slat (120).

The slats (110,120,130) of the module described herein (100) may be made from any material which has the required strength and also a certain bendability. Such materials are well-known to those skilled in the art. In specific embodiments, the slats (110,120,130) are made from one or more materials selected from wood or plastic.

Examples of suitable plastics are polymers, such as polyesters, polyamides and/or polyvinyl chloride (PVC). The two or three slats (110,120,130) of the module (100) may be made from the same materials or may differ in composition.

The length and the width of the (first slat of the) module (100) will depend on the application, for example the sleeping system in which it is being used. More particularly, the length of the module (100) typically corresponds to the width of the sleeping system for which it is to be used. The desired width of the module (100) may depend on factors such as the length of the sleeping system for which it is to be used, the location of the module within the sleeping system, and the total number of modules in the sleeping system. Typically, a module (100) as described herein has a length of between 60 cm and 250 cm and a width of between 5 cm and 50 cm. In specific embodiments, the module has a width of between 10 and 40 cm, preferably of approximately 15 cm. The sleeping systems which comprise the modules (100) may have a width of between 70 cm and 120 cm or double this. In specific embodiments, the sleeping systems may have a width of approximately 70 cm, approximately 80 cm, approximately 90 cm, approximately 100 cm, approximately 110 cm, or approximately 120 cm or double this. In this way, the sleeping systems can be composed of zones which comprise different modules (100).

The module (100) described herein may be used to construct a sleeping system (see below), in which the first slat (110) forms a part of the lying surface. In the present module, in contrast to known systems for slatted bases, the slats (120,130) which are provided with sliding elements (141-146) do not themselves form the lying surface of the sleeping system. This makes it possible to adjust the stiffness of the module (100) by displacing the sliding elements (141-146) over the slats, even when the user is sleeping.

If the first slat (110) is situated at the top (as part of the lying surface), the first slat (110) is supported by the second slat (120) via the connections (112,114) between these two slats (110,120).

The second slat (120) may then rest, for example, on the floor. In order to permit bending or torsion of the second slat (120) in such a configuration, the second slat (120) is preferably placed on a support element (150) which ensures contact of the second slat (120) with the floor. This support element (150) preferably supports the second slat (120) in the centre (with respect to the longitudinal axis of the second slat (120)), in which case the second slat (120) (and thus also the remainder of the module (100)) overhangs on either side of the support element (150). The overhang is typically symmetrical with respect to the support element (150). In a preferred embodiment, the overhang on each side of the support element (150) is at least 20%, for example at least 30%, for example at least 40% of the length of the second slat (120). Typically, the sliding elements (141-146) will be situated on opposite sides of the support element (150).

In specific embodiments of the module described herein, the second slat (120) of the module (100) is thus provided with a central (with respect to the longitudinal axis of the second slat (120)) support element (150) for supporting the module (100), wherein the sliding elements (141-146) are situated at an opposite side of the support element (150). In particular embodiments, the support element (150) may rest directly on the floor. However, it is envisaged that in certain embodiments, the support element (150) itself may be supported by an intermediate element. For example, the support element (150) may be connected to the bed frame of a sleeping system comprising a bed frame. The support element (150) may for example be configured as a beam which is supported by (and suspended from) the bed frame, wherein this beam runs along the length of the bed frame (and thus substantially perpendicular to the individual modules (100)) and is positioned such that it can support the modules (100) on a central location with respect to the longitudinal axis of the second slat.

The overhang of the module (100) on either side of the support element (150) ensures that the second slat (120) can bend over a certain distance or can perform a torsional movement over a certain angle when the first slat (110) is subjected to load. In case the load on the first slat (110) is uneven, the module (100) has to be prevented from tilting. In order to offer sufficient stability, the attachment of the second slat (120) to the support element (150) will typically be made as rigid as possible. In order to further increase the stability of the module (100), the second slat (120) may be provided at one or both ends with an additional supporting or anchoring element which can ensure that the module (100) is supported on and/or adheres to the floor. In specific embodiments, the additional supporting or anchoring element is configured in such a manner that it only supports the module on the floor when the module (100) is subjected to load. In specific embodiments the additional supporting or anchoring element comprises a resilient element which ensures that the module is anchored to the floor at all times, but in which the resilience ensures that the bending of the second slat (120) is not impeded by the additional supporting or anchoring element. In specific embodiments, the additional supporting or anchoring element comprises an attenuating element which ensures that the module (100) is anchored to the floor at all times, but in which the attenuation ensures that the element does not prevent bending of the second slat (120) and in which the attenuation ensures that dynamic effects during bending are attenuated. Combinations of the above-described embodiments are also possible. In specific embodiments, the support element (150) preferably has a height of at least at least 2 cm, preferably at least 5 cm, so that the second slat (120) is able to bend to a sufficient degree.

If the module is provided with a third slat (130), the module may be supported by a bed frame which rests on the floor and at least partially surrounds the modules. More particularly, the module can be suspended from the bed frame via the ends of the third slat. In such embodiments, the module does not touch the ground and does not require a support element as described above. The support via the ends of the third slat makes it simpler to obtain a stable configuration compared to support via a central support element as described above.

The connection of the module (100) to the bed frame via the third slat can ensure a stable positioning of the module while still allowing for (vertical) movement of the first slat (110) and the second slat (120). Accordingly, the connection does not interfere with the functioning of the slats.

If the module is to be supported via the third slat (130), the third slat preferably is longer than the first slat (110) and the second slat (120) as to facilitate the mounting of the third slat on the bed frame. However, this is not critical.

In order to facilitate the connection between the third slat (130) and the bed frame, the third slat and the bed frame may be provided with matching coupling features, which ensure a stable connection of the module to the bed frame via the third slat (130).

The application provides for the modules (100) described herein to be used in sleeping systems, such as inter alia, but not exclusively, those described herein. Although the advantages of the module (100) described herein are best appreciated when different modules (100) are combined to form the sleeping systems described herein, it is also possible to use a module (100) on its own or as a component in combination with other arrangements in other sleeping systems. Thus, the module (100) described herein may form part of a bed in which the rest of the lying surface is formed by other elements.

In addition, the use of the modules (100) described herein may also apply to other arrangements, such as a canapé (daybed).

In a further aspect, sleeping systems are provided which comprise two or more modules (100) as described above. The modular construction of the sleeping system makes it possible to adjust the sleeping system to the needs of the user in a simple way.

In the sleeping systems described herein, the modules (100) are preferably positioned in such a way that the first slat (110) of each module (100) forms a part of the lying surface of the sleeping system, in which case the long side of a first slat (110) of one module (100) preferably adjoins the long side of a subsequent module (100). Preferably, a certain distance is kept between two adjacent slats. Thus, when a first slat in a first module is loaded or changes position, it is possible to prevent the position of the first slat in the adjacent module from being affected. In specific embodiments, two adjacent slats are at a distance of between 1 mm and 15 cm from each other, preferably between 10 mm and 10 cm from each other.

As described above, the first slat (110) in each module (100) of the sleeping system will be supported by the second slat (120) of the same module (100). In such a configuration, the modules (100) described herein are extremely suitable for constructing an adaptive sleeping system.

In a preferred embodiment, the lying surface of the sleeping system is entirely composed of a number of modules (100) as described herein. However, this is not compulsory. In specific embodiments, the lying surface of the sleeping system may be formed in part by one or more modules (100) as described above, with the rest of the lying surface being formed by other elements. Thus, it is, for example, possible to provide only modules (100) for those zones of the sleeping system which are most critical to support of the body, such as the zone at the position of the hips or the shoulders. For other zones, it is optionally possible to provide a different system, for example a classic slatted base.

The exact number of modules (100) which constitute the sleeping system may depend on the user, for example on the height of the user. A larger number of modules (100) typically allows a greater degree of freedom in adapting the sleeping system to the user.

In specific embodiments, the sleeping system described herein comprises at least three modules (100) as described above. In specific embodiments, the sleeping system comprises at least five, at least seven or at least eight modules (100) as described herein.

The individual modules (100) of the sleeping system may be identical to each other or differ from each other. In specific embodiments, two or more modules (100) of the sleeping system have a different width. Thus, the sleeping system can be adapted to the anatomy of the user even more precisely. However, in other embodiments it is provided that all modules (100) are of equal width.

The width of the (lying surface of the) sleeping system is typically determined by the length of the first slat (110) of the modules (100). The first slat (110) of the separate modules (100) of the sleeping system preferably always has the same length, so that the width of the sleeping system remains identical along the entire length of the sleeping system.

As has been described above, the modules (100) of the sleeping system may be supported by a central support element (150). In specific embodiments, two or more modules (100) are supported by the same and/or a common support element (150). This may simplify alignment of the modules (100) with respect to each other. However, it is also possible to provide a separate support element (150) for each module (100).

In specific embodiments, the sleeping system comprises a frame which at least partially surrounds the modules (100) which are coupled to each other. Such a frame may be used to physically protect and visually screen the modules (100) from the user. The frame may, for example, protect the modules (100) against lateral forces which can subject the connection between the first slat (110) and the second slat (120) to a heavy load. Moreover, the frame may be used for supporting the modules. In particular, each module may be suspended from the frame via its third slat (130) as described above and shown in the examples (see further). Additionally or alternatively, the frame may also be used for supporting a central beam which functions as a supporting element (150) as described above.

In specific embodiments, the above-described modules (100) or sleeping systems may be provided with one or more actuators (147-149) for checking the position of the sliding elements of one or more modules. More particularly, the actuator (147-149) may ensure the movement of a pair of sliding elements (141-146) towards each other and away from each other. Actuators (147-149) which are able to produce such a movement of the sliding elements are known to those skilled in the art.

In specific embodiments, at least one of the modules (100) is provided with a dedicated actuator (147). In specific embodiments of the sleeping system, each module (100) is therefore also provided with a dedicated actuator (147). In this way, it is possible to change the adjustments of the different modules (100) simultaneously and independently from each other. However, often neighbouring modules (100) will be subjected to a similar load and may thus be adjusted in a similar way. Therefore, the adjustments of two or more (neighbouring) modules (100) within a group in one sleeping system may be checked using one single actuator (147-149), for example via a common drive shaft.

In specific embodiments, the sleeping system described herein comprises at least two groups which each comprise one or more modules (100), in which each group is provided with a separate actuator (147-149) for checking the position of the sliding elements within the group.

The use of actuators (147-149) makes it possible to automate the adjustment of a module or of the separate (groups of) modules (100) of a sleeping system. In specific embodiments, actuation may be initiated by user command, for example via a remote control or another interface.

Figure 9:
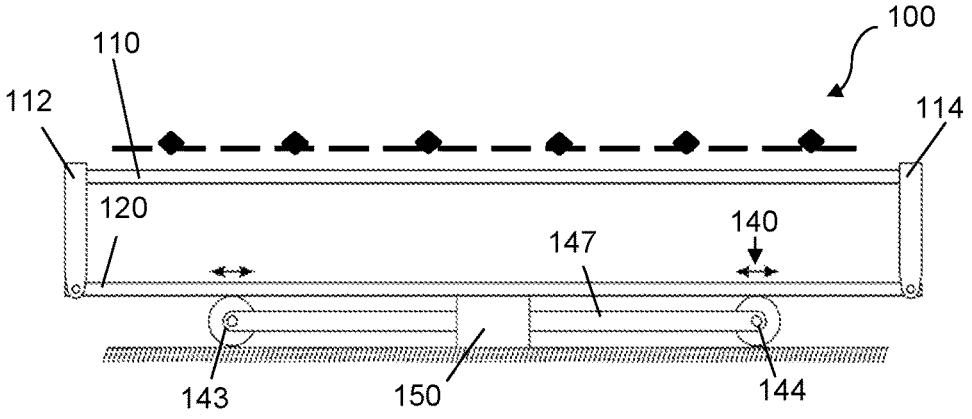
FIG. 9. Module (100) according to a specific embodiment of the present invention wherein the module (100) comprises sensors (represented by diamond shapes) provided in a sensor mat (represented by a dashed line).

However, it is also possible to control the actuator(s) (147-149) on the basis of the output of one or more sensors, for example accelerometers, position sensors and/or pressure sensors. In these embodiments, a manual adjustment is replaced by an automatic adjustment, so that the settings can also be changed while the user is sleeping, for example when the user changes position. Thus, the module (100) or the sleeping system can ensure optimum support of the body in virtually every sleeping position. In specific embodiments, the sensors may be provided as a sensor mat which can be placed above the lying surface (FIG. 9), for example directly on the lying surface and/or the mattress. An example of a suitable sensor mat is the Idoshape system developed by Custom8 (Belgium).

The present invention will be illustrated by the following non-limiting embodiments.

EXAMPLES

FIG. 1 illustrates the operation of a module (100) with a sliding system comprising sliding elements (141, 142) according to a preferred embodiment of the invention, by means of a cross section. As is illustrated in FIG. 1A, the module (100) comprises a first horizontal slat (110) which is connected to a flexible second horizontal slat (120) by means of coupling elements (112,114). The coupling elements are rigidly connected to the first horizontal slat (110), whereas the connection to the second horizontal slat (120) is hinged. The second horizontal slat (120) rests on a support element (150) above the floor. A third horizontal slat (130) is coupled to the second horizontal slat (120) by means of two sliding elements (141,142) which, in FIG. 1A, are situated close to the support element (150), but which, in FIG. 1C, are situated further away from the support element (150). As is illustrated in FIG. 1B, the space between the first horizontal slat (110) and the second horizontal slat (120) and the space between the second horizontal slat (120) and the floor ensures that the second horizontal slat (120) can bend when pressure is being exerted on the first horizontal slat (110). FIG. 1D illustrates how the bending of the second horizontal slat (120) is limited when the sliding elements (141,142) are situated further away from the support element (150) and how this results in the second horizontal slat (120) and the third horizontal slat (130) being coupled to each other over a relatively large length.

FIG. 6 illustrates the operation of a module (100) with a sliding system comprising sliding elements (141, 142) according to a particularly preferred embodiment of the invention, by means of a cross section. The module has a similar structure as the module of FIG. 1 and works in a similar way, except in that the module is not supported by a support element. Instead, the module is supported by a bed frame (160) which surrounds the module. More particularly, the module (100) is suspended from the frame (160) via the ends of the third horizontal slat (130), which extend from the outer ends of the module.

Figure 6A:
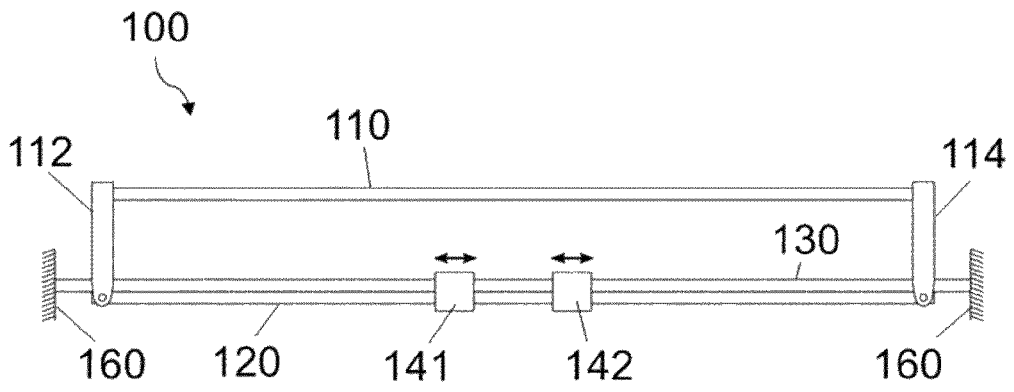
FIG. 6 Module (100) according to a specific embodiment of the present invention, wherein, in FIGS. 6A and 6B, the position of the sliding elements (141,142) permits a relatively large degree of bending of the second horizontal slat (120), and wherein, in FIGS. 6C and 6D, the position of the sliding elements (141,142) only permits a relatively small degree of bending of the second horizontal slat (120). The module (100) comprises a third horizontal slat (130) which allows for connecting the module (100) to a frame (160).
Figure 6B:
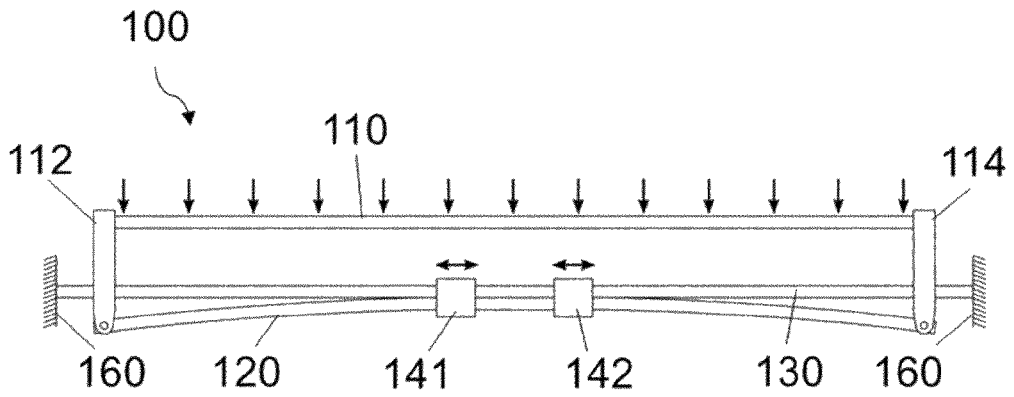
Figure 6C:
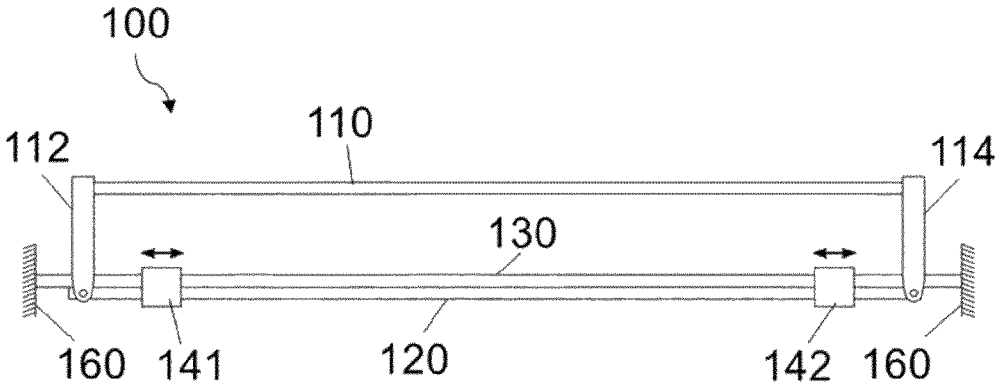
Figure 6D:
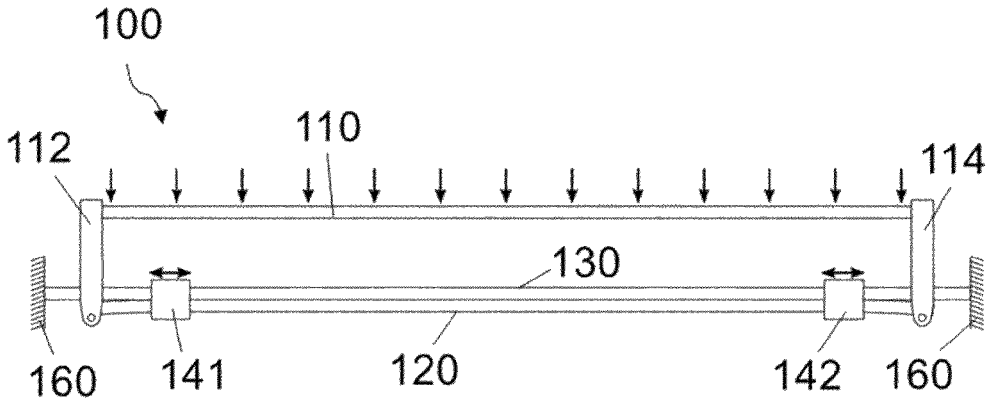

In FIG. 6A, the two sliding elements (141, 142) are positioned relatively close to each other in the center of the second (120) and third (130) horizontal slats. In FIG. 6C, the sliding elements (141, 142) are situated further away from each other. As is illustrated in FIG. 6B, the space between the first horizontal slat (110) and the second horizontal slat (120) and the space between the second horizontal slat (120) and the floor ensures that the second horizontal slat (120) can bend when pressure is being exerted on the first horizontal slat (110). FIG. 6D illustrates how the bending of the second horizontal slat (120) is limited when the sliding elements (141,142) are situated further away from each other and how this results in the second horizontal slat (120) and the third horizontal slat (130) being coupled to each other over a relatively large length.

Figure 8:
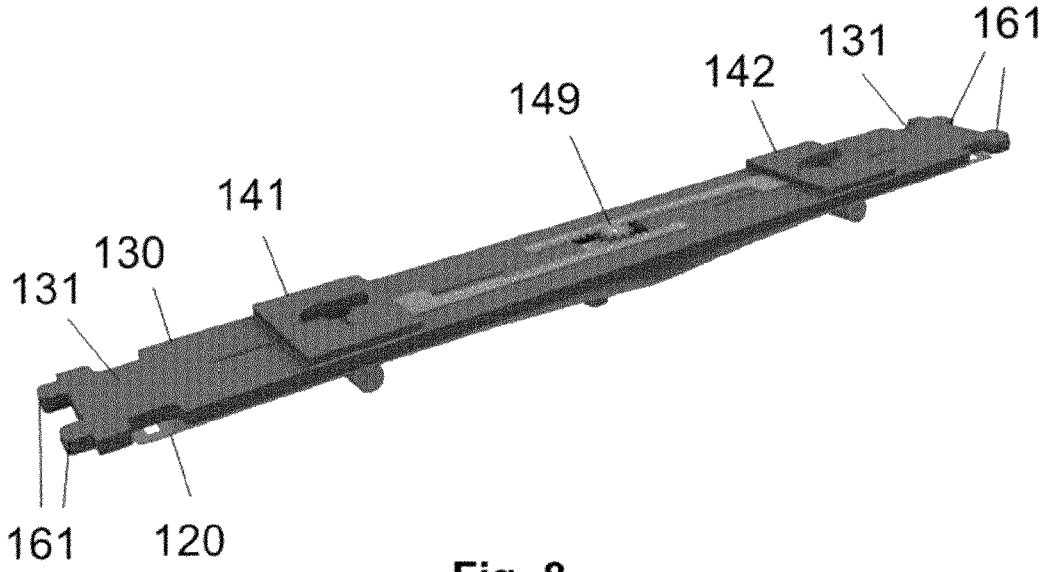
FIG. 8 Assembly of a second horizontal slat (120) and a third horizontal slat (130) for a particular embodiment of the module (100) described herein.

FIG. 8 illustrates an exemplary assembly of a second horizontal slat (120) and a third horizontal slat (130) suitable for use in a module (100) as shown in FIG. 6. In the assembly, the third horizontal slat (130) is longer than the second horizontal slat (120) as to facilitate positioning the third horizontal slat (130) on a bed frame. More particularly, the third horizontal slat (130) may be provided with protrusions (161) or other coupling features which cooperate with matching holes or other coupling features provided on the frame (not shown). The second horizontal slat (120) and the third horizontal slat (130) are connected via sliding elements (141, 142), which are driven by an actuator comprising a rack and pinion system (149). Such a system allows for a symmetrical movement of the sliding elements in a simple way. The ends of the third horizontal slat (130) are provided with narrowed regions (131) in order to facilitate connecting the second horizontal slat (120) to a first horizontal slat (not shown) via coupling elements.

Figure 7A:
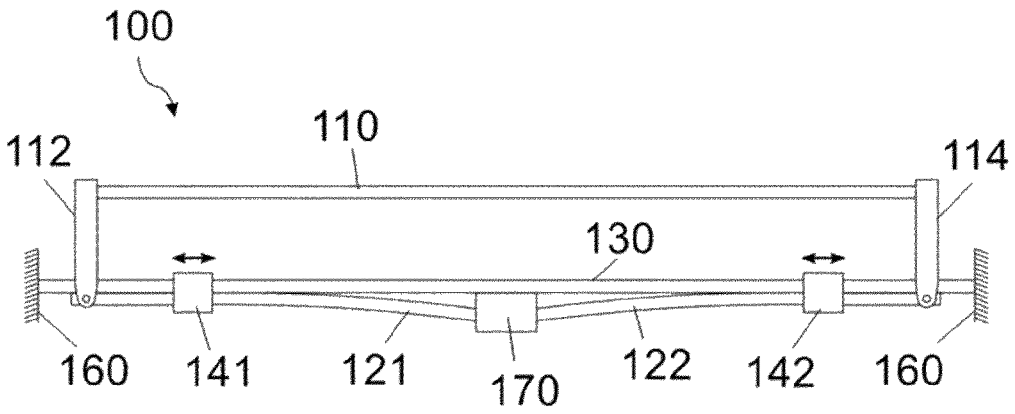
FIG. 7 A, B: Module (100) according to a specific embodiment of the present invention, wherein the second horizontal slat is made from two slats (121, 122) which are positioned in line with each other and are interconnected via an intermediate part (170, 171).
Figure 7B:
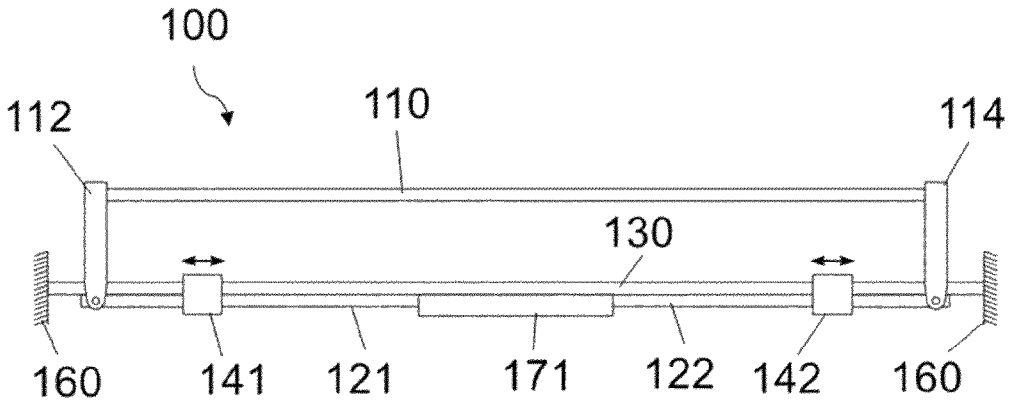

FIG. 7 illustrates a module (100) which has a similar structure as the module of FIG. 6 and works in a similar way, except in that the second horizontal slat is not provided as a single piece. In FIG. 7A, the second horizontal slat is formed from a first part (121) and a second part (122), which are connected via a connector (170). The third horizontal slat (130), the two parts (121, 122) and the connector (170) are configured such that the second horizontal slat formed by the parts is pre-stressed. In FIG. 7B, the second horizontal slat is formed from a first part (121) and a second part (122), which are indirectly connected via a connector (171) which is fixed to the third horizontal slat (130).

In an alternative configuration, the connector (171) may be formed of first and second connector parts which are separate from each other but indirectly connected to each other via the third horizontal slat. The first connector part may then be connected to the first part (121) of the second horizontal slat while the second connector part can be connected to the second part (121) of the second horizontal slat.

Figure 2:
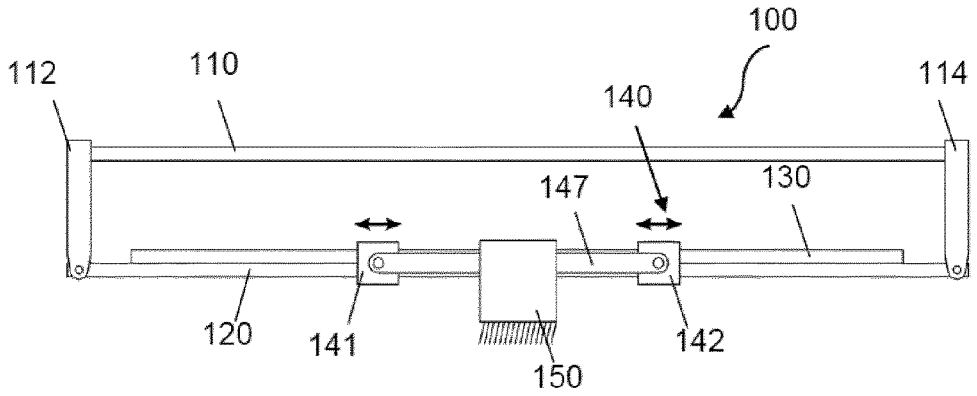
FIG. 2 Module (100) according to a specific embodiment of the present invention, wherein an actuator (147) drives the sliding elements (141,142).

FIG. 2 illustrates the operation of a module (100) according to a preferred embodiment of the invention by means of a cross section. FIG. 2 illustrates how the sliding elements (141,142) in a module (100) as illustrated in FIG. 1 can be driven by means of an actuator (147).

Figure 3:
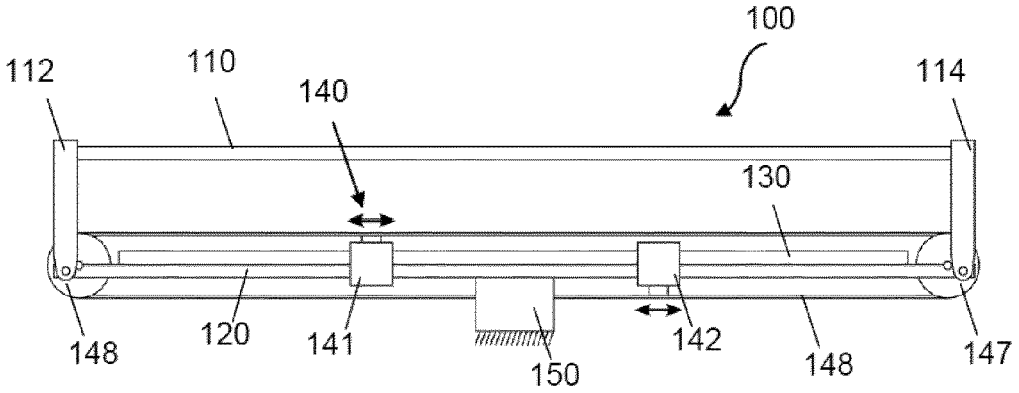
FIG. 3 Module (100) according to a specific embodiment of the present invention, wherein a drive belt (148) drives the sliding elements (141,142).
Figure 4A:
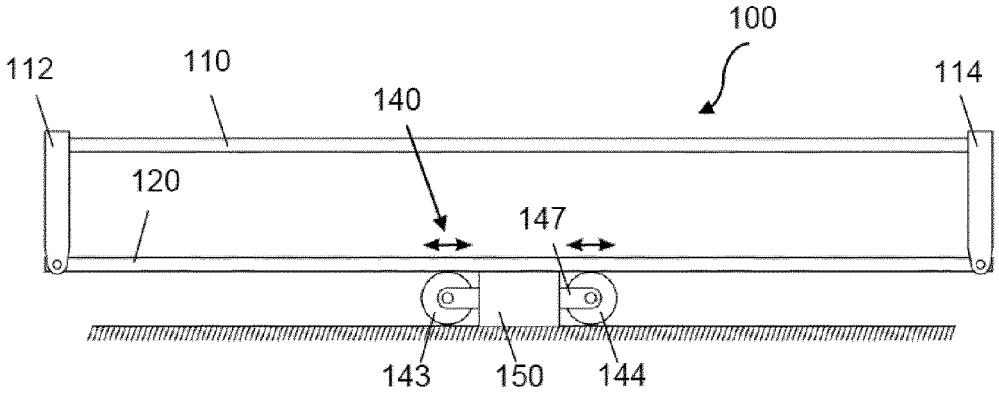
FIG. 4 Module (100) according to a specific embodiment of the present invention, wherein, in FIGS. 4A and 4B, the position of the sliding elements (143,144) permits a relatively large degree of bending of the second horizontal slat (120), and wherein, in FIGS. 4C and 4D, the position of the sliding elements (143,144) only permits a relatively small degree of bending of the second horizontal slat (120).
Figure 4B:
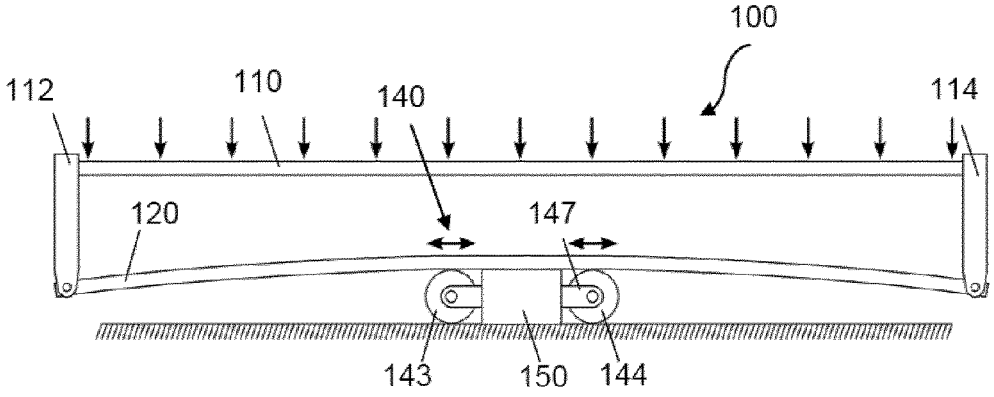
Figure 4C:
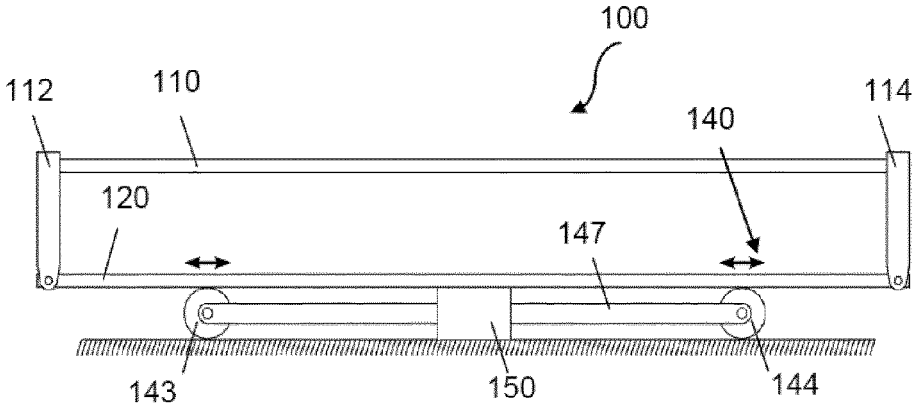
Figure 4D:
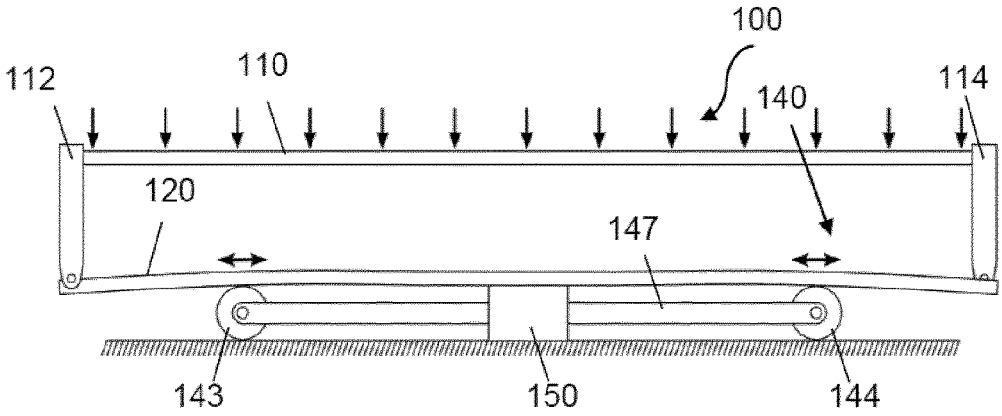

FIG. 3 illustrates the operation of a module (100) according to a preferred embodiment of the invention, by means of a cross section. FIG. 3 illustrates how the sliding elements (141,142) in a module (100) as illustrated in FIG. 1 can be driven by means of a drive belt (148), coupled to one or more pulleys (147).

FIG. 4 illustrates the operation of a module (100) with a sliding system (140) according to a preferred embodiment of the invention, by means of a cross section. As illustrated in FIG. 4A, the module (100) comprises a first horizontal slat (110) which is connected to a flexible second horizontal slat (120) by means of coupling elements (112,114). The second horizontal slat (120) rests on a support element (150) above the floor. The second horizontal slat (120) is furthermore supported by means of two sliding elements (143,144), in this case roller elements, which are situated close to the support element (150) in FIG. 4A, but which are situated further from the support element (150) in FIG. 4C. As illustrated in FIG. 4B, the space between the first horizontal slat (110) and the second horizontal slat (120) and the space between the second horizontal slat (120) and the floor ensures that the second horizontal slat (120) is able to bend when pressure is exerted on the first horizontal slat (110). FIG. 4D illustrates how the degree of bending of the second horizontal slat (120) is limited when the sliding elements (143,144) are situated further from the support element (150) and thus support the second horizontal slat (120) over a relatively great length.

FIG. 5 illustrates the operation of a module (100) with a sliding system (140) according to a specific embodiment of the invention, by means of a cross section (FIGS. 5 B, D and F) and a perspective drawing (FIGS. 5 A, C and E).

Figure 5A:
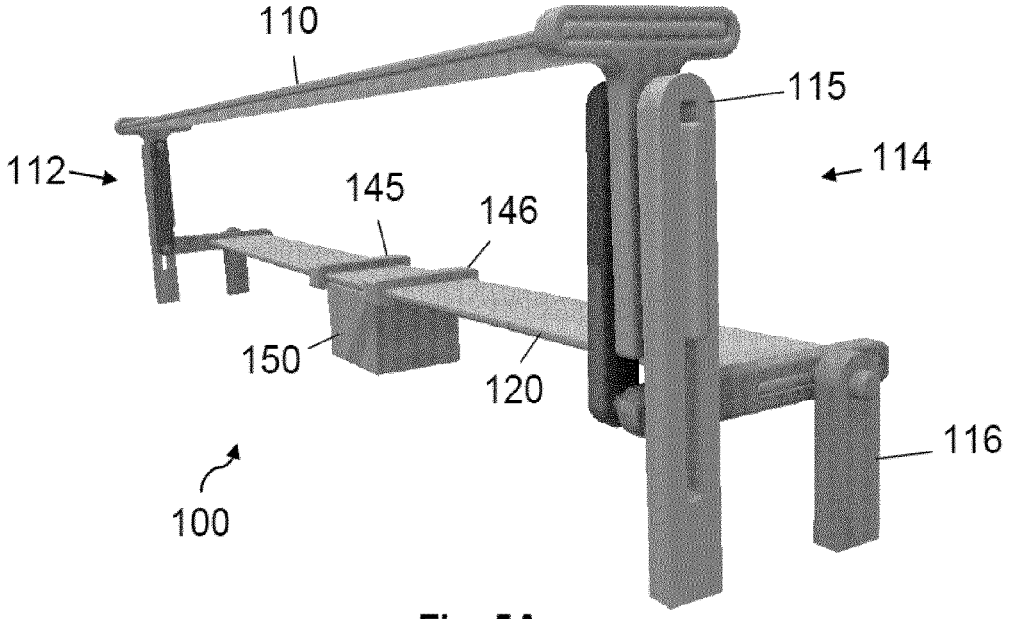
FIG. 5 Module (100) according to a specific embodiment of the present invention in the unloaded state (A-B) and loaded state (C-E), wherein, in FIGS. 5C and 5D, the position of the sliding elements (145,146) permits a relatively large degree of torsion of the second horizontal slat (120), and wherein, in FIGS. 5E and 5F, the position of the sliding elements (145,146) permits a relatively small degree of torsion of the second horizontal slat (120).
Figure 5B:
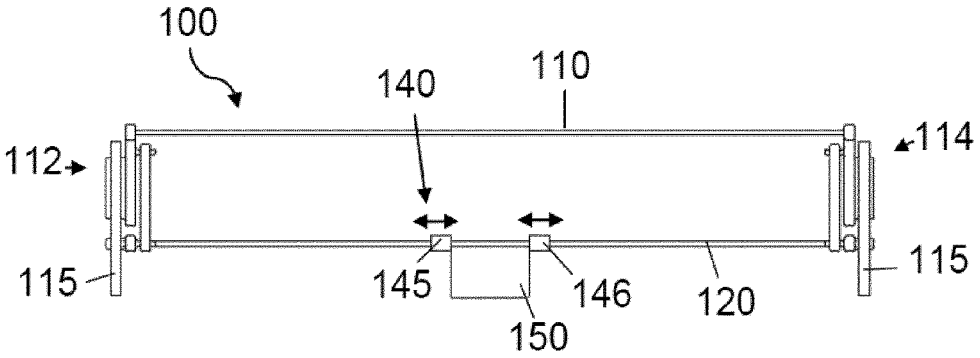
Figure 5C:
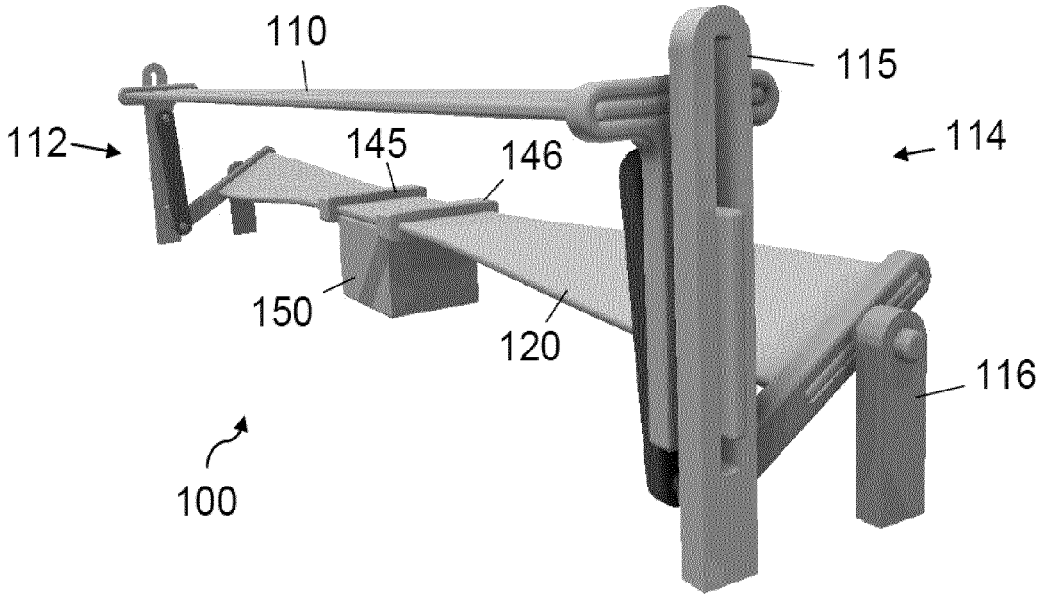
Figure 5D:
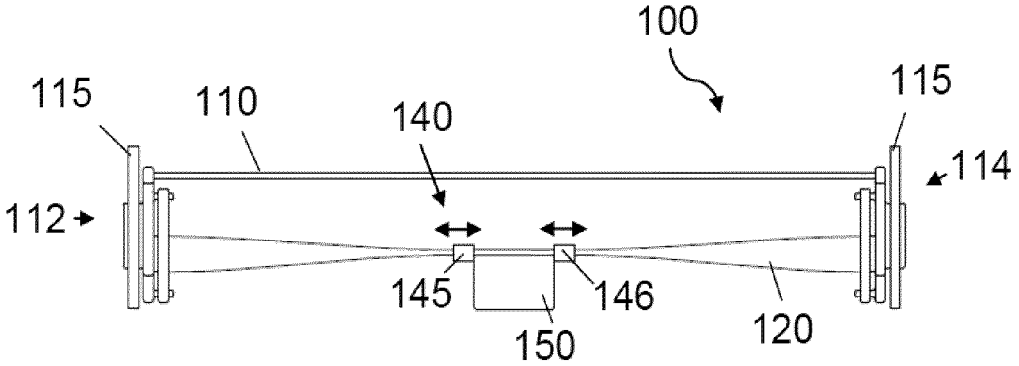

FIGS. 5A and 5B show the module (100) in the unloaded state. The module (100) comprises a first horizontal slat (110) which is connected to a flexible second horizontal slat (120) via the ends by means of coupling elements (112,114). The coupling elements consist of different separate parts, inter alia a guide (115) which permits the first horizontal slat (110) to (only) move vertically, and a support (116) which supports an end of the second horizontal slat. The support (116) is hingedly connected to the second horizontal slat so that it (only) permits a rotation of the second horizontal slat about its longitudinal axis. The coupling elements (112, 114) are configured in such a way that a vertical movement of the first horizontal slat results in a rotation of the second horizontal slat about its longitudinal axis. It will be clear to the person skilled in the art that such an effect can also be produced using other coupling elements than those shown in FIG. 5.

The second horizontal slat (120) rests on a central support element (150) above the floor and is provided with two sliding elements (145,146). The space between the first horizontal slat (110) and the second horizontal slat (120) and the space between the second horizontal slat (120) and the floor ensures that the second horizontal slat (120) can perform a rotating movement when pressure is exerted on the first horizontal slat (110).

The sliding elements (145, 146) have a fixed rotational position and a fixed height with respect to the floor. This may be achieved, for example, by connecting the sliding elements to the central support element (150) or by resting the sliding elements on the floor. The sliding elements (145, 146) securely clamp the second slat, so that the portion of the slat between the two sliding elements is not able to perform a translational or rotating movement.

The combination of the sliding elements (145, 146) and the coupling elements (112, 114) ensures that the ends of the second horizontal slat rotate about the longitudinal axis of the second slat when a load is exerted on the first horizontal slat, while the position of the portion of the slat between the two sliding elements does not change. This causes torsion of the second horizontal slat, as is illustrated in FIGS. 5C-F.

The position of the sliding elements determines the portion of the second horizontal slat which can rotate freely, and thus also the torsional stiffness. In FIGS. 5A-D, the sliding elements are close to the support element (150), resulting in minimal torsional stiffness.

Figure 5E:
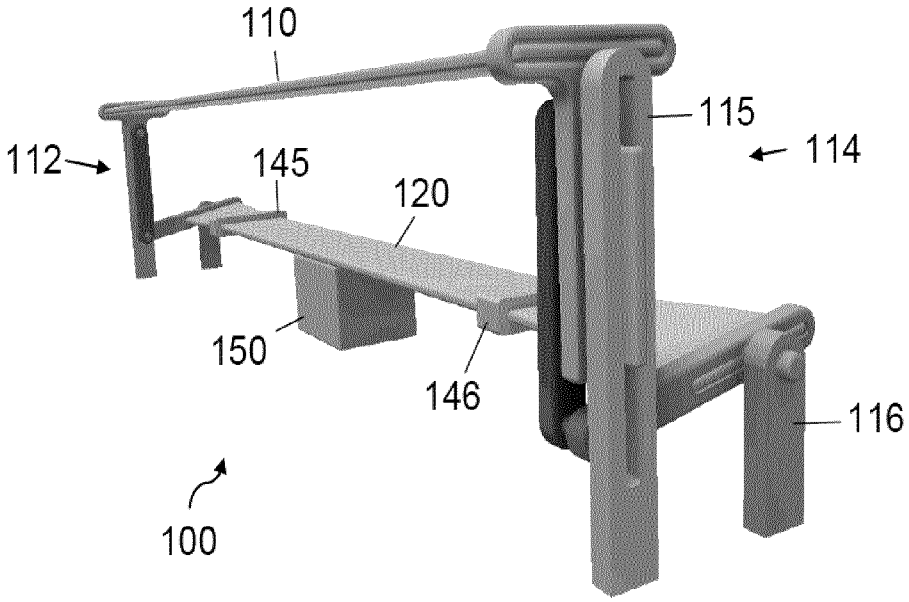
Figure 5F:
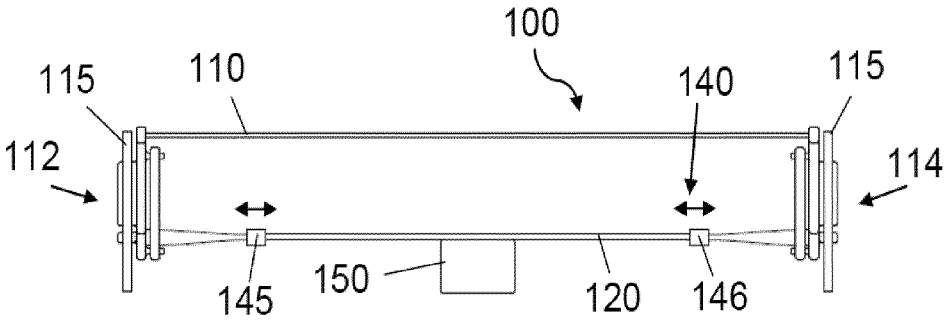

In FIGS. 5E and F, the sliding elements are situated further from the support element (150), resulting in greater torsional stiffness. Consequently, in FIGS. 5C and 5D, the second horizontal slat undergoes torsion at a greater angle than in FIGS. 5E and 5F, and thus produces a greater change in position of the first horizontal slat.

The invention claimed is:

1. A module (100) for a sleeping system, comprising a first horizontal slat (110) and a second horizontal slat (120), each having ends, the first horizontal slat (110) being positioned above the second horizontal slat (120), wherein the ends of the first horizontal slat (110) and the second horizontal slat (120) are connected to each other in pairs by means of coupling elements (112,114) without the first horizontal slat (110) and the second horizontal slat (120) directly touching one another; and a sliding system (140), comprising two or more sliding elements (141-146) which differ from the coupling elements (112, 114), wherein the two or more sliding elements (141-146) are configured to slide over at least part of the length of the second horizontal slat (120);

the position of the two or more sliding elements (141-146) determines the resistance to bending or torsion of the second horizontal slat (120); and the first horizontal slat does not directly contact said sliding elements when a load is applied to the first horizontal slat.

2. The module (100) according to claim 1, further comprising a third horizontal slat (130) positioned between the first horizontal slat (110) and the second horizontal slat (120), wherein the third horizontal slat (130) is coupled to the second horizontal slat (120) by means of the two or more sliding elements (141,142), which can each be displaced over at least part of the length of the second horizontal slat (120) and of the third horizontal slat (130).

3. The module (100) according to claim 2, wherein the third horizontal slat (130) is longer than the second horizontal slat (120).

4. The module (100) according to claim 1, wherein the two or more sliding elements (143,144) support the second horizontal slat (120), and can each be displaced over at least part of the length of the second horizontal slat (120).

5. The module (100) according to claim 4, wherein the two or more sliding elements (143,144) support the second horizontal slat (120) by means of roller elements.

6. The module (100) according to claim 1, wherein the two or more sliding elements (145, 146) ensure a fixed position of the portion of the second horizontal slat (120) between the sliding elements (145, 146) with respect to the floor; and the coupling elements (112, 114) are configured to cause a rotational change in position of the ends of the second horizontal slat (120) when the height of the first horizontal slat (110) with respect to the floor changes.

7. The module (100) according to claim 1, wherein said second horizontal slat comprises two or more interconnected parts which are positioned in line with each other.

8. The module according to claim 1, wherein the two or more sliding elements (141-146) are driven by an actuator (147-149).

9. The module according to claim 1, wherein said second horizontal slat (120) is coupled to a central support element (150) for supporting the module (100), wherein the two or more sliding elements (141-146) are situated at opposite sides of the support element (150).

10. The module according to claim 1, wherein the first horizontal slat (110) has a greater stiffness than the second horizontal slat (120).

11. Modular sleeping system comprising two or more modules (100) according to claim 1.

12. The modular sleeping system according to claim 11, wherein the two or more modules (100) are coupled to each other in such a way that the first horizontal slats (110) and the second horizontal slats (120) of the different modules (100) are positioned parallel to one another, wherein the first horizontal slats (110) of the modules (100) together form a lying surface.

13. The modular sleeping system according to claim 12, wherein said modules each comprise a third horizontal slat (130) positioned between the first horizontal slat (110) and the second horizontal slat (120), wherein the third horizontal slat (130) is coupled to the second horizontal slat (120) by means of the two or more sliding elements (141,142), which can each be displaced over at least part of the length of the second horizontal slat (120) and of the third horizontal slat (130);

said modular sleeping system further comprises a frame (160) at least partially surrounding said modules (100); and each of said modules is suspended from said frame via said third horizontal slat (130).

14. The modular sleeping system according to claim 11, further comprising one or more sensors which control a drive mechanism of the two or more sliding elements (141-146), wherein the one or more sensors are provided in a mat which is provided above the first horizontal slats (110) of the two or more modules (100).

15. The modular sleeping system according to claim 11, comprising at least two groups of modules (100), wherein each group of said at least two groups of modules (100) comprises one or more modules (100), and wherein each group of said at least two groups of modules (100) is provided with a separate actuator for driving the two or more sliding elements (141-146) within the respective group of modules (100).

* * * * *